US008991959B2

(12) United States Patent
Nitta et al.

(10) Patent No.: US 8,991,959 B2
(45) Date of Patent: Mar. 31, 2015

(54) RECORDING APPARATUS AND METHOD FOR CONTROLLING RECORDING APPARATUS

(75) Inventors: Masaki Nitta, Yokohama (JP); Hiroaki Shirakawa, Kawasaki (JP); Yasunori Fujimoto, Inagi (JP); Taku Yokozawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/348,065

(22) Filed: Jan. 11, 2012

(65) Prior Publication Data

US 2012/0182338 A1 Jul. 19, 2012

Related U.S. Application Data

(63) Continuation of application No. 12/941,875, filed on Nov. 8, 2010, now Pat. No. 8,113,614, which is a continuation of application No. 12/121,326, filed on May 15, 2008, now Pat. No. 7,850,270.

(30) Foreign Application Priority Data

Jun. 1, 2007 (JP) ..... 2007-146930

(51) Int. Cl.
*B41J 29/38* (2006.01)
*B41J 2/21* (2006.01)

(52) U.S. Cl.
CPC ..... *B41J 2/2139* (2013.01)
USPC ..... 347/12

(58) Field of Classification Search
USPC ..... 347/12–14
See application file for complete search history.

(56) References Cited

FOREIGN PATENT DOCUMENTS

| | | | |
|---|---|---|---|
| EP | 510934 A2 | * | 10/1992 |
| JP | 05084911 A | * | 4/1993 |
| JP | 2001-088288 A | | 4/2001 |
| JP | 2004-314353 A | | 11/2004 |

OTHER PUBLICATIONS

Machine translation of JP 05-084911 A. (JP 05-084911 A was published Apr. 6, 1993).*

* cited by examiner

*Primary Examiner* — Justin Seo
(74) *Attorney, Agent, or Firm* — Canon USA, Inc., IP Division

(57) ABSTRACT

A recording apparatus including a recording head that includes an element array of a plurality of recording elements for discharging a liquid, the plurality of recording elements in the element array being divided into groups, and a drive unit configured to drive the recording head in a driving mode selected from a plurality of driving modes including a continuous driving mode in which recording elements in each of the groups are driven in order from one end and a distributed driving mode in which recording elements in each of the groups are driven such that adjacent recording elements are not driven sequentially.

9 Claims, 10 Drawing Sheets

FIG. 6

BLOCK NUMBER

| DRIVING ORDER | DRIVING ORDER A | DRIVING ORDER B |
|---|---|---|
| 1 | 0 | 0 |
| 2 | 10 | 8 |
| 3 | 1 | 4 |
| 4 | 11 | 12 |
| 5 | 2 | 16 |
| 6 | 12 | 2 |
| 7 | 3 | 10 |
| 8 | 13 | 6 |
| 9 | 4 | 14 |
| 10 | 14 | 18 |
| 11 | 5 | 1 |
| 12 | 15 | 9 |
| 13 | 6 | 5 |
| 14 | 16 | 13 |
| 15 | 7 | 17 |
| 16 | 17 | 3 |
| 17 | 8 | 11 |
| 18 | 18 | 7 |
| 19 | 9 | 15 |
| 20 | 19 | 19 |

FIG. 7

| RECORDING MODE | | NUMBER OF PASSES | DRIVING ORDER |
|---|---|---|---|
| TYPE OF MEDIUM | QUALITY | | |
| PLAIN PAPER | FAST | 2-PASS | DRIVING ORDER B |
| | STANDARD | 4-PASS | DRIVING ORDER A |
| | FINE | 8-PASS | DRIVING ORDER A |

RECORDING APPARATUS AND METHOD FOR CONTROLLING RECORDING APPARATUS

CROSS REFERENCE OF RELATED APPLICATIONS

This application is a continuation of U.S. patent application Ser. No. 12/941,875 filed Nov. 8, 2010 which is a continuation of U.S. Pat. No. 7,850,270 issued Dec. 14, 2010 which claims priority from Japanese Patent Application No. 2007-146930 filed Jun. 1, 2007, which are hereby incorporated by reference herein in their entirety.

BACKGROUND OF THE INVENTION

1. Field of the Invention

The present invention relates to a recording apparatus which discharges ink by time-division driving of a recording head arraying a plurality of nozzles and a method of controlling the recording apparatus.

2. Description of the Related Art

In recent years, with the widespread use of information-processing equipment, a recording apparatus as its peripheral equipment has also rapidly come into wide use. Among these recording apparatuses, since an ink jet recording apparatus has various advantages, it is adopted in many recording apparatuses. The ink jet recording apparatus scans a recording medium with a recording head, discharges ink droplets from the recording head in the scanning, and executes recording. The advantage of the ink jet recording apparatus is easy miniaturization, and color recording can be relatively simply performed.

Among the inkjet recording apparatuses, by a thermal ink jet method, high integration of a discharge mechanism is relatively easily performed and discharge ports for discharging ink can be arrayed at a high density. The thermal ink jet method utilizes bubbles generated by thermal energy to discharge ink. Owing to high density of the discharge ports, the recording apparatuses can be miniaturized and further, a high-quality image can be recorded at a high speed. In the recording apparatus using a recording head that arrays such many discharge ports, in order to simultaneously drive the entire array of discharge ports to discharge ink at the same timing, a large-capacity power source will be required. Thus, a time-division driving method has been adopted. The time-division driving method sequentially drives the predetermined number of discharge ports which are arranged on the recording head within a period of a driving cycle. More specifically, the time-division driving method typically divides the entire array of discharge ports of the recording head into a number of groups and bit by bit changes timing of driving for each group. Since the number of discharge ports to be simultaneously driven is reduced by executing this time-division driving, the capacity of a power source required for the recording apparatus can be reduced.

On the other hand, the ink jet recording method handles ink which is a fluid. This may cause various inconveniences due to a hydrodynamic phenomenon. For example, when ink is discharged from a certain discharge port, a pressure change generated at that time is propagated to adjacent discharge ports through an ink flow path to vibrate an ink interface of the discharge ports. This causes a significantly unstable state. Due to the vibration of the ink interface of the discharge ports, there has also been cases in which discharge ports after discharge of ink is not sufficiently filled with ink (unstableness of ink film). If ink is discharged in such an unstable state, a position to impact ink droplets on a recording medium may be shifted and the amount of ink droplets to be discharged from the discharge ports may fluctuate. The shift of the position of ink droplets or the fluctuation of the discharge amount of ink can result in an uneven density and a white streak on an image which is recorded on a recording medium. Since the color of a recording face of the recording medium is white and a white line is generated on the image, it is referred to as the white streak.

In order to solve a discharge failure due to the vibration of the ink interface, the level of a negative pressure generated in a liquid chamber can be approximated to a normal pressure by optimizing the timing and the discharge amount of time-division driving during discharge of ink (Japanese Patent Application Laid-Open No. 05-084911). Japanese Patent Application Laid-Open No. 05-084911 describes a technique of approximating the negative pressure generated in the liquid chamber to a normal pressure by optimum time-division driving, in which ink is discharged with a small and stable amplitude of the vibration in ink-refill, and a driving frequency is enhanced.

However, even when the time-division driving is executed so as to reduce the amplitude of the vibration in the ink-refill, there has been the case in which an impact position of an ink droplet adhering to a recording medium is shifted. In order to achieve recording with a high image quality which is required in a recent recording apparatus, there are recording heads that include a nozzle array of discharge ports arranged at a high density or an increased number of nozzle arrays. When ink is continuously and sequentially discharged from the discharge ports arranged at a high density, an air current is generated between the nozzle face of the recording head and the recording medium by discharged ink droplets. The generation of this air current places the vicinity thereof in a state of a negative pressure. Thus, a flying direction of the ink droplet discharged from nozzles can be changed. This deviates the flying direction of the ink from a desired flying direction. As a result, the impact position (dot position) of the recording medium can be shifted. As described above, due to a white streak thus generated, an image quality is degraded.

The higher a density (Duty) of an image recorded by a single recording scan, a white streak generated on a recording medium may be more noticeable. This is because when a high-Duty image is recorded, a generated air current becomes larger, so that the amount of shifts in a flight direction of an ink droplet is increased.

SUMMARY OF THE INVENTION

An embodiment of the present invention is directed to a recording apparatus that uses a recording head arranged at a high density to record a high-quality image and its method.

According to an aspect of the present invention, a recording apparatus for discharging ink from a recording head arraying a plurality of nozzles to execute recording of an image includes a drive unit configured to form a group with a defined number of nozzles so as to include an adjacent nozzle among the plurality of nozzles in a different block and to execute time-division driving of the block of the group according to a driving order corresponding to a recording mode, a recording control unit configured to execute scan recording to a recording medium in a first recording mode or a second recording mode, wherein each pass of scan recording in the second recording mode is executed using nozzles smaller in number than a number of nozzles used to execute each pass of scan recording in the first recording mode, and a driving control unit configured to control the drive unit so as to make a drive interval of an adjacent nozzle in the same group corresponding to the first recording mode larger than a drive interval of an adjacent nozzle in the same group corresponding to the second recording mode.

According to another aspect of the present invention, a method for discharging ink from a recording head arraying a plurality of nozzles to execute recording of an image includes forming a group with a defined number of nozzles so as to include an adjacent nozzle among the plurality of nozzles in a different block to execute time-division driving of the block in the group according to a driving order corresponding to a recording mode, executing scan recording to a recording medium in a first recording mode or a second recording mode, wherein each pass of scan recording in the second recording mode is executed using nozzles smaller in number than a number of nozzles used to execute each pass of scan recording in the first recording mode, and controlling the time-division driving wherein a drive interval of an adjacent nozzle in the same group corresponding to the first recording mode is larger than a drive interval of an adjacent nozzle in the same group corresponding to the second recording mode.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 is a table illustrating a driving method to be applied to a recording apparatus.

FIG. 7 is a table illustrating the relation between a recording mode which is operated by a recording apparatus and a driving method.

DETAILED DESCRIPTION OF THE EMBODIMENTS

Various exemplary embodiments, features, and aspects of the invention will be described in detail below with reference to the drawings.

Figure 1:
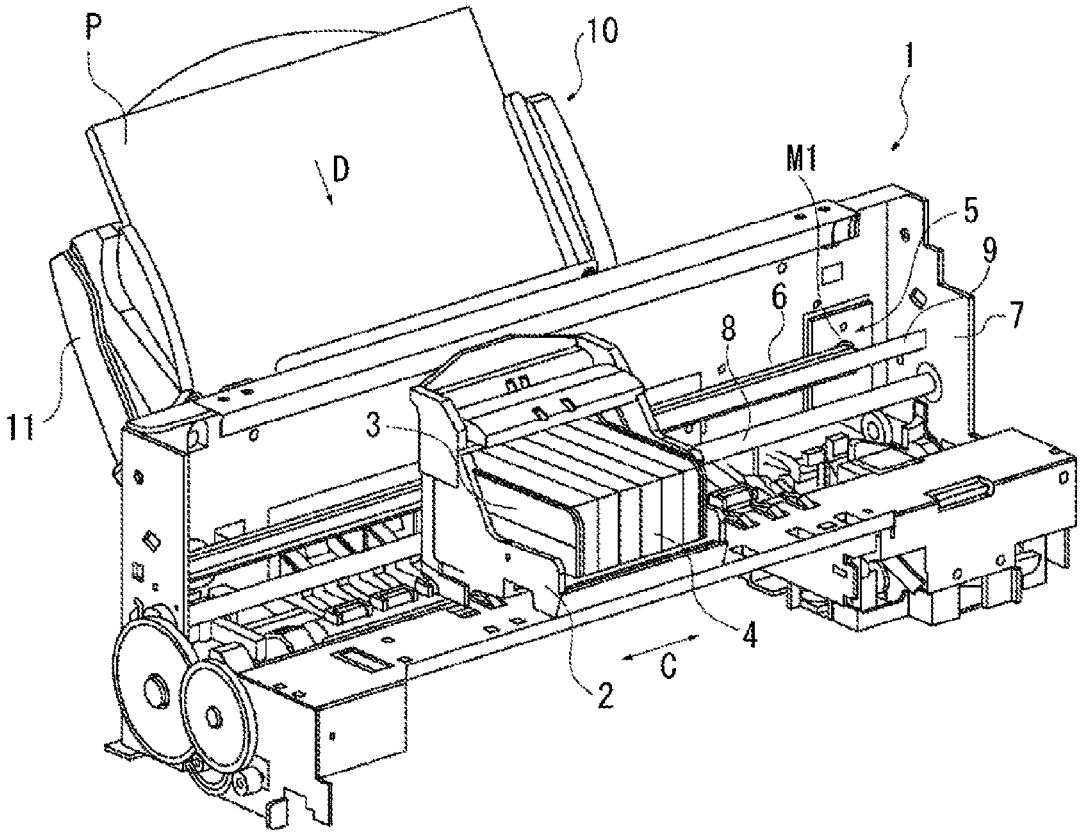
FIG. 1 is a perspective view illustrating an ink jet recording apparatus according to an exemplary embodiment of the present invention.

FIG. 1 is a perspective view illustrating an ink jet recording apparatus according to an exemplary embodiment of the present invention.

An ink jet recording apparatus 1 includes a carriage 2 which carries out a reciprocating scan in a main scanning direction indicated by an arrow C and a recording head 3 which is mounted on the carriage 2 to discharge ink. Further, an ink jet cartridge 4 which receives ink and supplies it to the recording head 3 is detachably held on the recording head 3.

The ink jet cartridge 4 contains black ink (K), and color ink of cyan (C), light cyan (LC), magenta (M), light magenta (LM), and yellow (Y) respectively. The recording head 3 has a nozzle array for discharging black ink and five nozzle arrays used in discharging each color ink. Each nozzle array includes 1,280 discharge ports.

The carriage 2 is movably guided in a direction of an arrow C in FIG. 1, that is a main scanning direction, by a guide shaft 8 attached to a casing 7. The carriage 2 is connected to a driving belt 6 that is included in a transmission mechanism 5 for transmitting driving force of a carriage motor M1. Thus, by rotating the carriage motor M1 in a normal or an opposite direction, the carriage 2 is reciprocally moved along the guide shaft 8. Further, in the casing 7, a scale (encoder) 9 which indicates an absolute position in a main scanning direction of the carriage 2 is disposed in parallel with the guide shaft 8.

At the back of the casing 7, a paper feed mechanism 10 is disposed. A plurality of recording mediums P having various sizes such as an A4 size paper and a postcard size paper can be mounted on a paper feed tray 11 which is included in the paper feed mechanism 10. The paper feed mechanism 10 includes a separation roller (not shown) which is driven by a paper feed motor (not shown). The recording medium P is fed from the paper feed tray 11 by the separation roller and supplied (conveyed) to a recording position opposing a recording head on the carriage 2.

During recording, the carriage 2 is moved in a forward direction of an arrow C (for example, direction of movement from home position side to another end). While making a movement, ink droplets are discharged from each nozzle of the recording head 3 toward the recording medium P according to image data. Execution of recording while moving the carriage 2 is referred to as a recording scan. When the carriage 2 reaches another end of the recording medium P, the separation roller is rotated by a predetermined amount, thereby conveying the recording medium P in a direction of an arrow D (sub scanning direction, or conveying direction) by a predetermined amount. Then, recording is executed again while the carriage 2 is moved in a backward direction of the arrow C (for example, direction of movement from another end to home position side). In this way, the recording scan of the carriage 2 and the conveyance operation of the recording medium P are repeated to record an image on the entire recording medium P.

The recording head 3 includes an electrothermal transducer (hereinafter, described as heater) for converting electric energy into thermal energy. Ink is film-boiled by thermal energy generated by the heater. The ink is discharged utilizing a pressure change generated by the growth and the contraction of bubbles due to the film-boiling. The heater is provided on respective discharge ports (also referred to as nozzle) that configure each nozzle array. A drive pulse voltage is applied to each heater in order to discharge ink.

Figure 2:
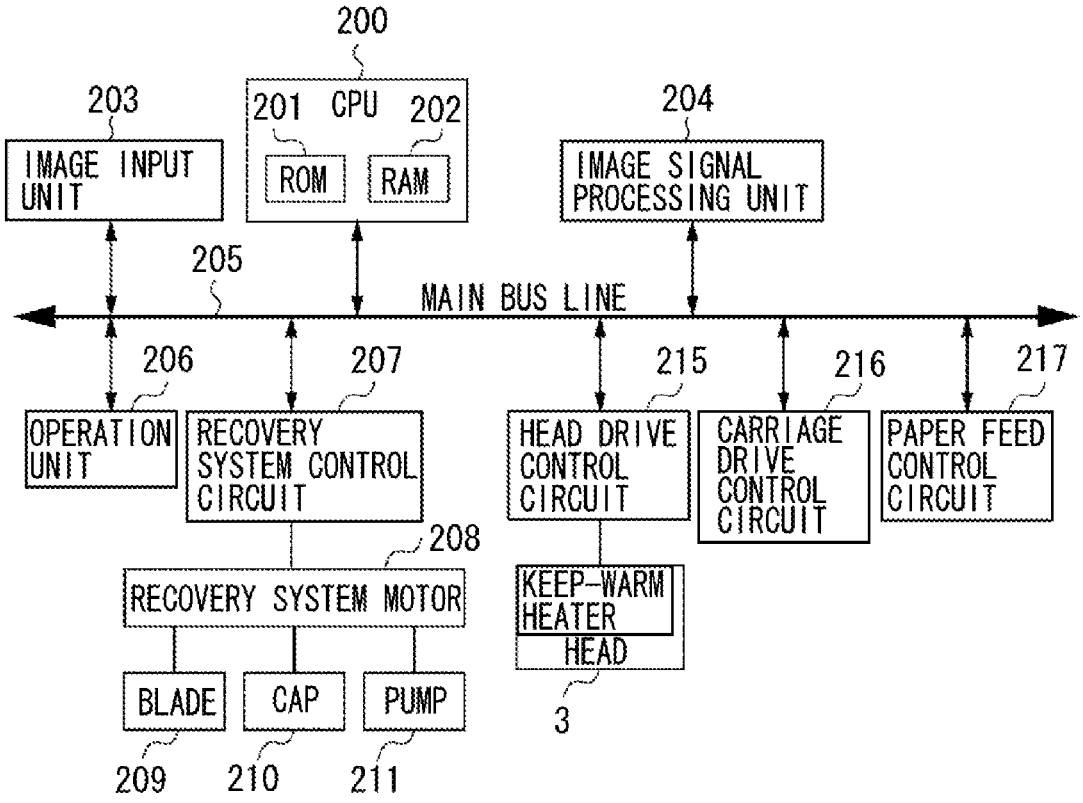
FIG. 2 illustrates a control configuration of an ink jet recording apparatus.

FIG. 2 is a block diagram illustrating a control configuration of an ink jet recording apparatus according to an exemplary embodiment of the present invention.

The ink jet recording apparatus in the present exemplary embodiment is connected to a host computer (personal computer (PC) or the like). The ink jet recording apparatus records image data containing image information and recording information generated using applications or the like of the host computer. A central processing unit (CPU) 200 controls the ink jet recording apparatus. The CPU 200 includes a read only memory (ROM) 201 and a random access memory (RAM) 202. Then, the CPU 200 transmits a drive command to each drive unit via a main bus line 205, thereby controlling a recording apparatus. The main bus line 205 is connected with an image input unit 203 and an image signal processing unit 204. The image information (image data) from the host computer is input to the image input unit 203 once and converted into an image signal (recording data) suitable for recording by the image signal processing unit 204. Further, the main bus line 205 is connected with an operation unit 206 through which an operator performs various settings concerning recording and a recovery system control circuit 207 linked to a recovery device for the recording head 3. Furthermore, the main bus line 205 is connected with a head drive control circuit 215, a carriage drive control circuit 216, and a paper feed (conveyance) control circuit 217 which are drive units respectively. Further, a program for driving each drive unit beforehand is stored in the RAM 202. The RAM 202 starts the program of each drive circuit in response to a drive command from the CPU 200.

The recording apparatus is connected to the host computer via an interface which is connected to the main bus line 205. In the above description, the host computer and the recoding apparatus are connected. However, in addition to the host computer, a digital camera and a flash memory can also be connected. In that case, the recording apparatus records an image shot by the digital camera and an image stored in the flash memory.

The recovery system control circuit 207 serves as a circuit which controls the recovery device to keep a good discharge condition of ink droplets discharged from the recording head 3. The recovery system control circuit 207 controls the driving of a recovery system motor 208, a blade 209, a cap 210, and a suction pump 211. The recovery device includes the blade 209 for wiping off ink droplets and dust adhering to the face of discharge ports, and the cap 210 which covers the face of the discharge ports when recording is not executed, so as to prevent evaporation of ink from the discharge ports. Further, the recovery device includes the suction pump 211. The suction pump 211 makes negative pressure inside the cap 210, thereby sucking ink in the recording head 3 to forcibly let out viscous ink inside nozzles.

The head drive control circuit 215 drives the electrothermal transducer of the recording head 3 according to recording data. The head drive control circuit 215 normally causes the recording head 3 to discharge ink for preliminary discharge and for recording of images, and further control temperature of ink and the recording head. The carriage drive control circuit 216 and the paper feed control circuit 217 also drive the carriage motor M1 and a conveyance motor according to a driving program respectively. The carriage drive control circuit 216 controls the driving of the carriage 2. The paper feed control circuit 217 controls a paper feed mechanism to feed and convey the recording medium P.

Figures 3A, 3B, 3C:
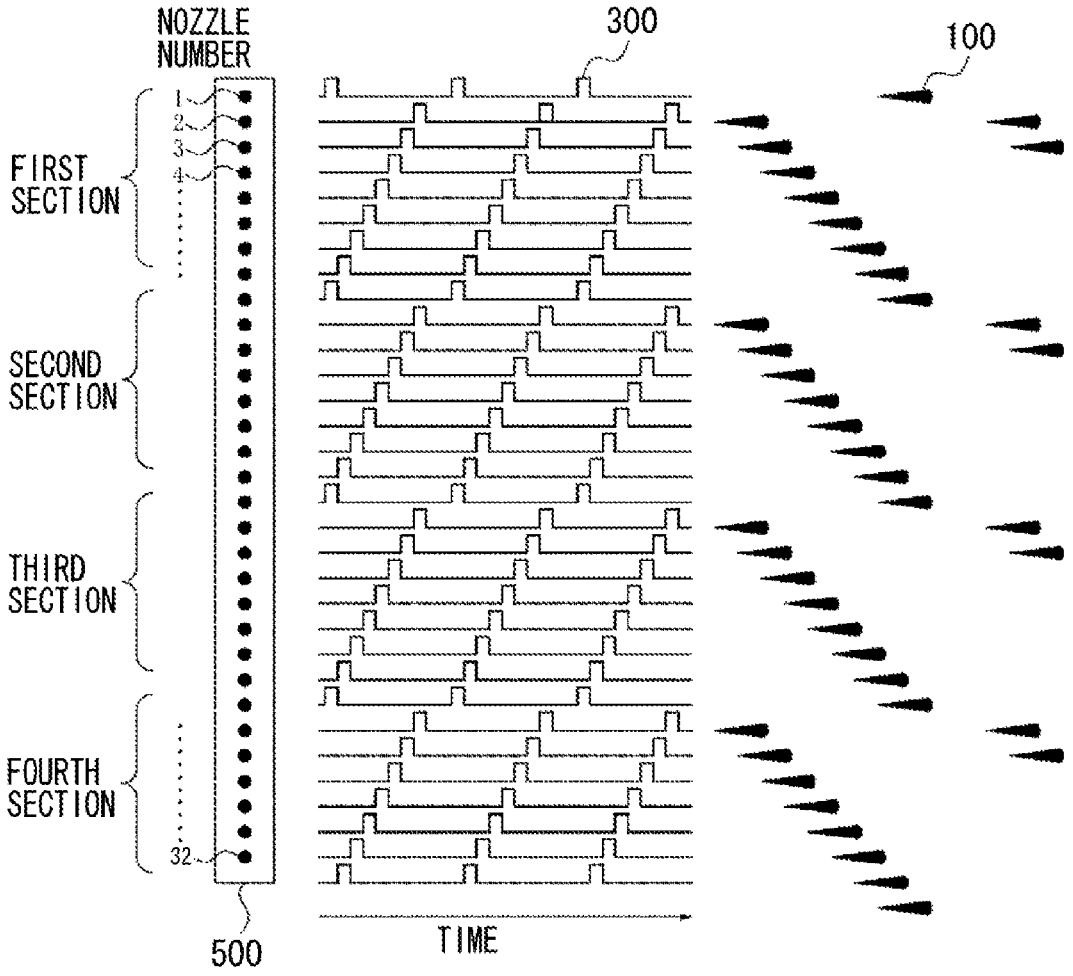
FIGS. 3A to 3C are diagrams illustrating a nozzle array of a recording head, a driving signal of a recording head, and ink to be discharged.

FIGS. 3A to 3C illustrate a nozzle array of a recording head, a driving signal to be applied to each nozzle, and a flying ink droplet discharged from each nozzle.

In FIG. 3A, a nozzle array 500 of the ink jet recording head includes, for example, 32 nozzles. These nozzles are divided into four sections (groups) from a first section to a fourth section with eight nozzles in each section in FIG. 3A. Further, each of eight nozzles in respective sections belongs to one of eight drive blocks. When recording is executed, the nozzle is time-shared block by block and sequentially driven. In the time-division driving, the nozzles having the same block number are simultaneously (concurrently) driven. In an example illustrated in FIG. 3B, four nozzles of the first, the ninth, the seventeenth, and the twenty fifth in the nozzle array 500 in FIG. 3A are simultaneously driven. The four nozzles of the first, the ninth, the seventeenth, and the twenty fifth belong to a first drive block (also simply referred to as first block). Four nozzles of the eighth, the sixteenth, the twenty fourth, and the thirty second are simultaneously driven. The four nozzles of the eighth, the sixteenth, the twenty fourth, and the thirty second belong to a second drive block. Similarly, the nozzles of the second, the tenth, the eighteenth, and the twenty sixth belong to an eighth drive block. As described above, the nozzles in each section are allocated to the respective drive blocks. In the case of the time-division driving that is sequentially driven in ascending order from the first drive block to the eighth drive block, each heater is sequentially driven based on a pulsed driving signal 300 illustrated in FIG. 3B. As illustrated in FIG. 3C, ink droplets 100 are discharged from each nozzle in response to a driving signal.

Next, a block configuration of the recording head 3 and a driving signal to be applied in the present exemplary embodiment will be described using FIGS. 4 and 5.

Figure 4:
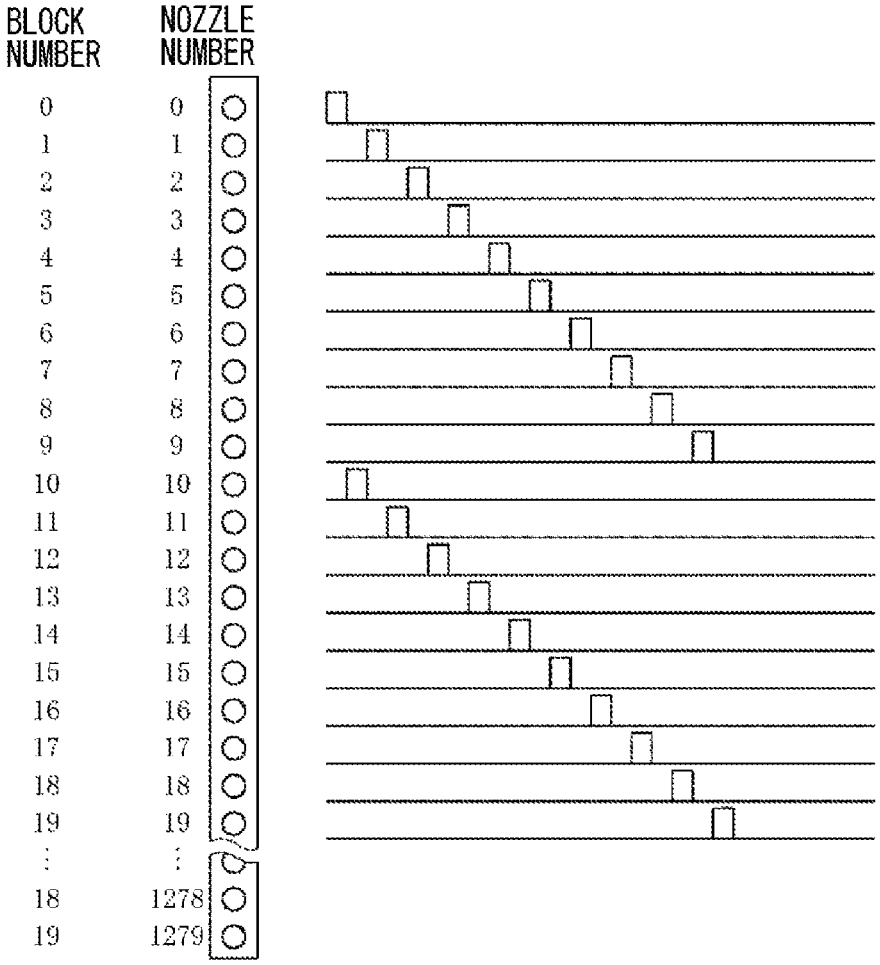
FIG. 4 is a diagram illustrating a driving method A according to an exemplary embodiment of the present invention.
Figure 5:
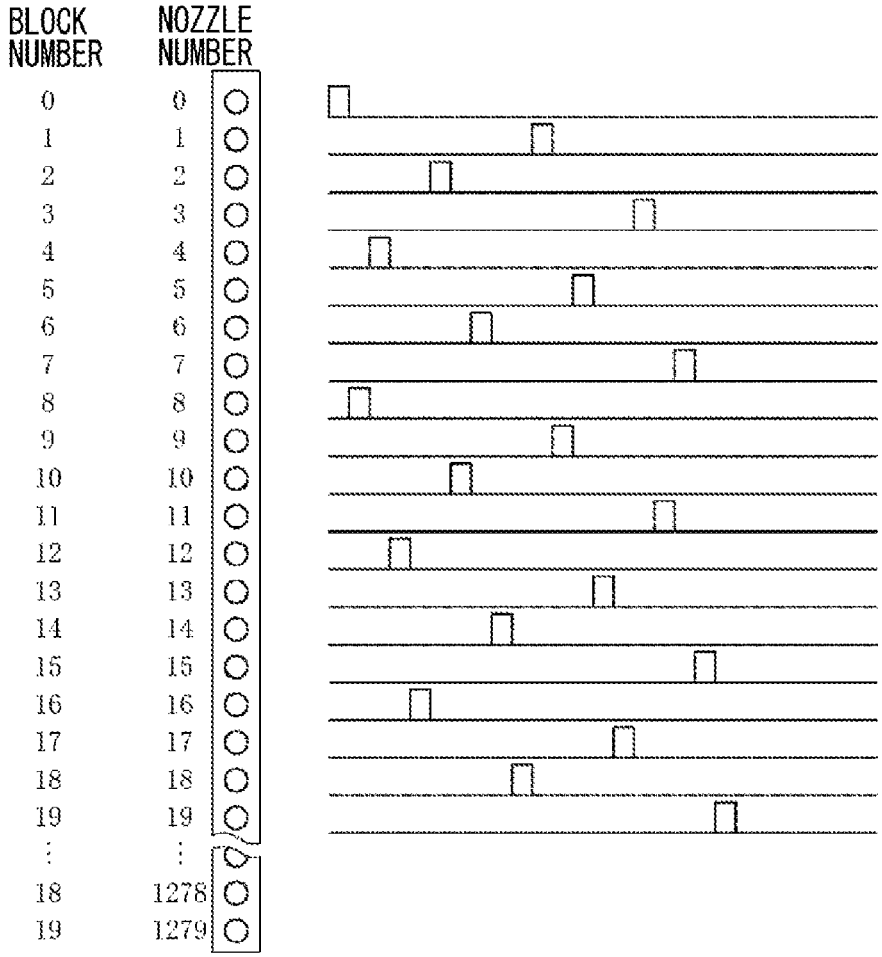
FIG. 5 is a diagram illustrating a driving method B according to an exemplary embodiment of the present invention.

As illustrated in FIG. 4, the present exemplary embodiment uses a nozzle array including 1,280 nozzles. One section is made of twenty nozzles. A first section includes nozzles from the zeroth to the nineteenth. The whole of the nozzle arrays is divided into 64 sections. Further, the number of blocks to be recorded per unit time (time-division number) is twenty. The number of blocks of a zeroth nozzle, a twentieth nozzle, . . . is zero. 64 nozzles having the same block number are simultaneously driven and ink is discharged. Note that, in FIG. 5, the configuration of sections and blocks is the same as in FIG. 4. While these twenty nozzles in one section are sequentially driven, the nozzles are all driven in one column. The recording head illustrated in FIGS. 4 and 5 is configured as a nozzle array in which 1,280 nozzles are arranged in a row. However, a recording head may be used in which two rows of a nozzle array including 640 nozzles are slightly shifted. It is also possible that one section is configured of continuous twenty nozzles for each array of the odd number row and even number row, and the nozzles of each section are subjected to block driving for each nozzle array.

FIG. 4 illustrates one example of time-division driving of a recording head. In FIG. 4, the recording head is sequentially driven from a top nozzle to a bottom nozzle spaced by one drive timing. This is referred to as a continuous driving order. For example, when ink is discharged from the entire nozzles, first, zeroth nozzle driving is executed and ink is discharged from a zeroth nozzle. Next, tenth nozzle driving is executed and ink is discharged from a tenth nozzle. Thereafter, first nozzle driving and eleventh nozzle driving are executed and ink is sequentially discharged from the respective nozzles. At this time, one section of the zeroth nozzle to the nineteenth nozzle is further divided into a subsection (first subsection) containing nozzles from the zeroth to the ninth nozzle and a subsection (second subsection) containing nozzles from the tenth nozzle to the nineteenth nozzle.

Figure 10:
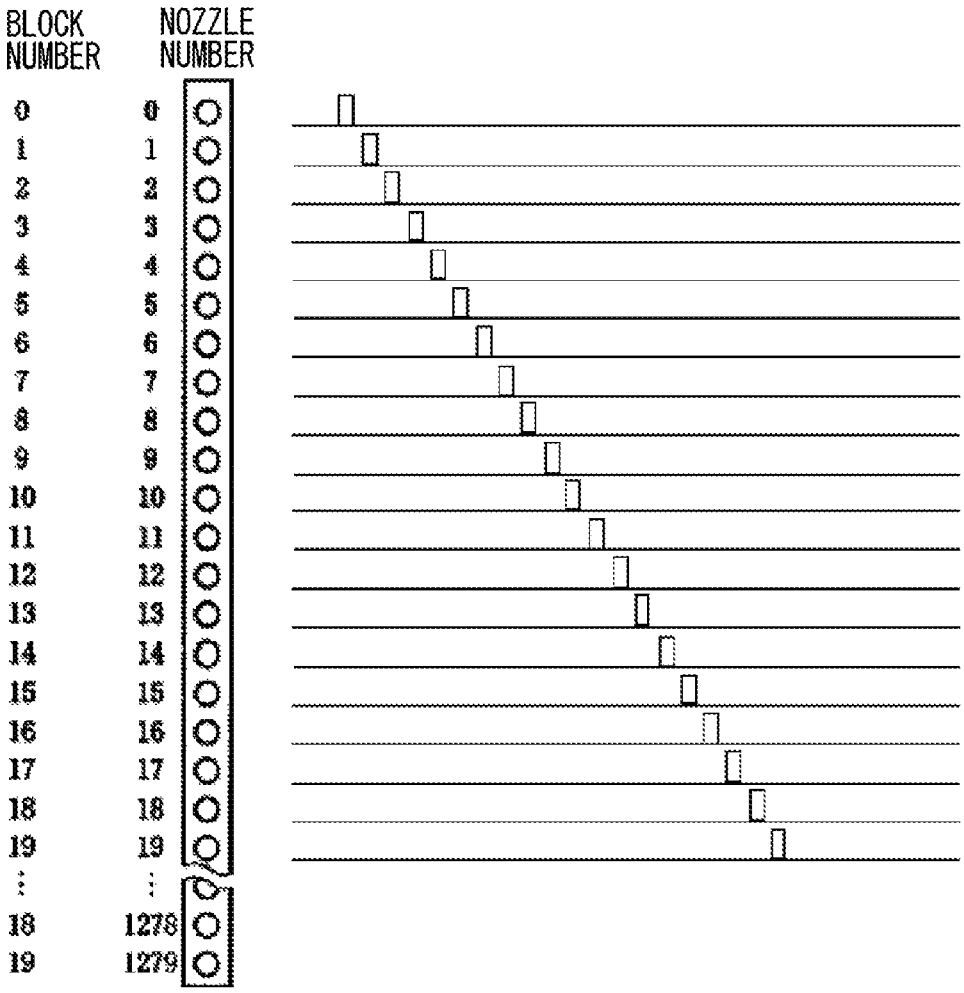
FIG. 10 is a diagram illustrating another driving method according to an exemplary embodiment of the present invention.

In FIG. 4, with respect to the first subsection (from zeroth nozzle to ninth nozzle), an adjacent nozzle is sequentially driven. Similarly, with respect to the second subsection (from tenth nozzle to nineteenth nozzle), an adjacent nozzle is sequentially driven. Here, block driving illustrated in FIG. 4 is also referred to as a continuous driving order. That is, sequentially driving of a plurality of nozzles is referred to as a continuous driving order. Alternatively, as illustrated in FIG. 10, an adjacent nozzle in one section containing nozzles from the zeroth to the nineteenth is sequentially and continuously driven from the zeroth nozzle to the nineteenth. This may also be referred to as a continuous driving order. Note that when 2-pass recording is executed, for example, on the first pass, an even number nozzle is a recordable nozzle among nozzles from the zeroth to the nineteenth and recording is executed by the even number nozzle. Further, on the second pass, an odd number nozzle is a recordable nozzle and recording is executed by the odd number nozzle. Recordable nozzles are selected by masking recording data corresponding to nozzles. That is, the mask processing of data corresponding to even number nozzles and the mask processing of data corresponding to odd number nozzles are executed corresponding to scanning by a recording head. Two types of mask patterns are provided to perform such control. Thus, when 4-pass recording is executed, four types of mask patterns are provided. Such mask control of data is also performed in distributed driving.

Conventionally, when ink is sequentially discharged from an adjacent nozzle, the ink interface of the adjacent nozzle is vibrated by the discharge. When the ink interface is vibrated, it has been known that the discharge of ink from nozzles become unstable (this is represented as crosstalk). However, the inventors of the present invention have found that if the large vibration of the ink interface is avoided, stable ink discharge can be achieved even in a mode of sequentially discharging ink from the adjacent nozzle depending on the condition of the viscosity of ink, the shape of a liquid chamber, the driving frequency of a nozzle, or the like. That is, it has been found that when ink is sequentially discharged from the adjacent nozzle, if drive timing which sequentially drives blocks is fast, a high-quality image can be recorded.

For example, referring to FIG. 4, ink discharge from a first nozzle is completed before a pressure change due to ink discharge from a zeroth nozzle is propagated to the first nozzle. If the drive is controlled in such a manner, the first nozzle can discharge ink well in a stable state.

As a result, good recording having a less shift of an impact position and a less fluctuation of the discharge amount of ink droplets can be achieved. Further, ink is discharged with a stable ink interface, which reduces generation of a mist or a satellite, and occurrence of a discharge failure caused by a stain of a recording medium or a recording apparatus or by adherence of the mist or satellite to the face of a discharge port.

However, as described above, when ink is sequentially discharged from an adjacent nozzle, in an ink droplet discharged later among continuously discharged ink droplets, the accuracy of a recording position worsens under influence of an air current generated by an ink droplet discharged before. This is referred to as end touch. Referring to FIG. 4, when the discharge number per unit time is high, respective ink droplets of a ninth nozzle and a nineteenth nozzle are drawn in a direction of an eighth nozzle and an eighteenth nozzle under the influence of the air current generated by the discharge of continuous ink droplets. Under the influence of this air current, the impact position of ink droplets discharged from a ninth nozzle and a nineteenth nozzle is shifted, so that a white line (white streak) is generated on an area corresponding to the ninth nozzle among images formed by a first to an eighteenth nozzle. Since this white line is generated for each continuous-type drive group and has periodicity, the white line is noticeable and will reduce an image quality.

This white streak is almost obvious when the Duty of image data is high or the number of nozzles used in recording at one time-division driving is high. In addition, when an air current is generated due to discharge of ink droplets which is executed in a short period of time or the amount of which is large, the white streak is generated. In other words, this white streak is generated if the Duty of image data recorded by one recording scan is high and the number of nozzles used in recording in one recording scan is high. Accordingly, when time-division driving of a recording head is executed, distributed driving is performed. By performing this distributed driving, an influence of the above-described air current can be suppressed.

For example, a recording apparatus includes a plurality of recording modes for forming an image. To realize a high image quality, the recording apparatus includes a recording mode in which the predetermined number of scan recording is performed on the same area of a recording medium to complete the image.

As described later, a control unit (for example, CPU 200) provided on the recording apparatus can execute a speed priority mode ("fast" mode), a standard mode ("standard" mode), and an image quality priority mode ("fine" mode). The speed priority mode performs two scan recordings on the same area of a recording medium to complete an image. The standard mode performs four scan recordings on the same area of a recording medium to complete an image. The image quality priority mode performs eight scan recordings on the same area of a recording medium to complete an image.

Further, in addition to continuous block driving which sequentially and continuously discharges ink from an adjacent nozzle, there is also a driving method in which ink is sequentially discharged not from an adjacent nozzle but from a separate nozzle. One example of such time-division driving is illustrated in FIG. 5. As illustrated in FIG. 5, a driving method of sequentially discharging ink from a nozzle which is not adjacent, is referred to as a distributed driving order since the drive timing of each nozzle is distributed. In the distributed driving in FIG. 5, when ink is discharged from all nozzles, first zeroth nozzle driving is executed and ink is discharged from a zeroth nozzle. Next, eighth nozzle driving is executed and ink is discharged from an eighth nozzle. Further, fourth nozzle driving is executed and ink is discharged from a fourth nozzle. Next, twentieth nozzle driving is executed and ink is discharged from a twentieth nozzle. Next, ink is discharged in order of a sixteenth nozzle, a second nozzle and so on. Thus, a nozzle to be driven in one section is driven in order of nozzles which are not adjacent, which is referred to as a distributed driving order. As a postscript of this distributed driving order, also in one section, a target nozzle is driven at least every three nozzles. While in the present exemplary embodiment, driving is executed at least every three nozzles, the present invention is not limited to this numeral value.

Conventionally, it has been known that ink is discharged in a stable state when drive timing is distributed and ink is discharged from nozzles which are not adjacent. In such a case, it has been considered that the ink discharge is in a stable state because when ink is discharged from nozzles, an ink interface of an adjacent nozzle is vibrated and an ink interface of nozzles apart from a nozzle discharging ink is not vibrated. Accordingly, it has been considered that ink from nozzles which are not adjacent is stably discharged. Alternatively, it has been considered that ink is stably discharged when ink is discharged after the vibration of an ink interface due to discharge of ink of an adjacent nozzle is settled.

However, the inventors of the present invention have found that even when ink is sequentially discharged from nozzles which are not adjacent by distributed driving similar to a conventional manner, unstable ink discharge can be caused by the vibration of an ink interface depending on the timing of block driving according to the condition of the viscosity of ink, the shape of a liquid chamber, the driving frequency of a nozzle, or the like. That is, even if the distributed driving is performed, ink can be discharged in an unstable state and the discharge amount of ink fluctuates.

As a result, smaller droplets having a less volume (referred to as mist or satellite) tend to be generated as compared with the case in which ink is discharged in a stable state. Since this mist adheres to the face of the discharge port of a recording head, the shift of the impact position of ink may occur or ink may not be discharged. Further, the mist tends to float in a recording apparatus, and adhere to various sensors and a recording apparatus main body. This causes the sensors to make false recognition and stains a recording medium.

Thus, it has been found that when the time-division driving is executed, execution of continuous driving is desirable. Further, it has been found that when the Duty of image data to be recorded in one recording scan is high and the number of nozzles used in recording in one recording scan is high, distributed driving is desirable.

That is, in a recording mode (speed priority mode) in which a relatively large number of nozzles is used in recording in one recording scan, driving nozzles of a recording head is performed by distributed driving. Further, in a recording mode (image quality priority mode) in which a relatively small number of nozzles is used in recording in one recording scan, driving nozzles of a recording head is performed by continuous driving.

A specific example will be described with reference to FIG. 6. A control unit (for example, CPU 200) of a recording apparatus includes two types of tables which indicate the order of block driving for use in recording as illustrated in FIG. 6 and uses a drive table based on a recording mode to be executed. In FIG. 6, a driving order A is a continuous driving order illustrated in FIG. 4 and a driving order B is a distributed driving order illustrated in FIG. 5. In the present exemplary embodiment, two types of driving orders which are a continuous type and a distributed type are prepared. However, other driving orders may also be used. Further, in each of the continuous type and the distributed type, a plurality of driving patterns may also be used.

A recording apparatus applicable to the present exemplary embodiment has three types of recording modes corresponding to an image quality as illustrated in FIG. 7. These three types are a "fast" mode, a "fine" mode and a "standard" mode. The "fast" mode is a recording mode that gives a higher priority to a recording speed than an image quality. The "fine" mode is a recording mode that gives a higher priority to an image quality than a recording speed, and the "standard" mode is a recording mode that considers both recording image quality and recording speed to perform well-balanced recording. A user can set these recording modes with a printer driver which is installed in a host computer and an operation unit of a recording apparatus. Further, the printer driver can also determine the type of an image and a recording medium to select a suitable recording mode.

For example, When a recording mode is the "standard" mode, 4-pass scan recording is executed to a recording medium to complete an image. When a recording mode is the "fast" mode, 2-pass scan recording is executed to a recording medium to complete an image. Further, when a recording mode is the "fine" mode, 8-pass scan recording is executed to a recording medium to complete an image.

Here, the higher the number of passes, the lower the number of nozzles used in recording per each pass. In other words, the higher the number of passes, the lower a recording duty in recording per each pass. The lower the number of passes, the higher the number of nozzles used in recording per one pass. In other words, the lower the number of passes, the higher a recording duty in recording per each pass. For example, when a nozzle array includes 1,280 nozzles, the "fast" mode uses 640 nozzles per one pass and the "fine" mode uses 160 nozzles per one pass.

FIG. 7 illustrates a table for setting a block driving order corresponding to an image quality. In FIG. 7, an example is provided in which the type of recording medium is plain paper. However, even when other recording media are used, a plurality of recording modes can be similarly selected and a driving order is selected according to the recording mode. This table is stored in the ROM 201 and the RAM 202.

In the present exemplary embodiment, when the "fast" mode is executed, the table of a distributed driving order B is used. As described above, this mode relatively increases the amount of generation of a mist. However, since the generation of a white streak can be suppressed, overall, an image quality is enhanced.

In the present exemplary embodiment, the "standard" mode and the "fine" mode use a continuous driving order A. Since both end touch and mist are hardly generated in these modes, a high-quality image can be formed.

Figure 8:
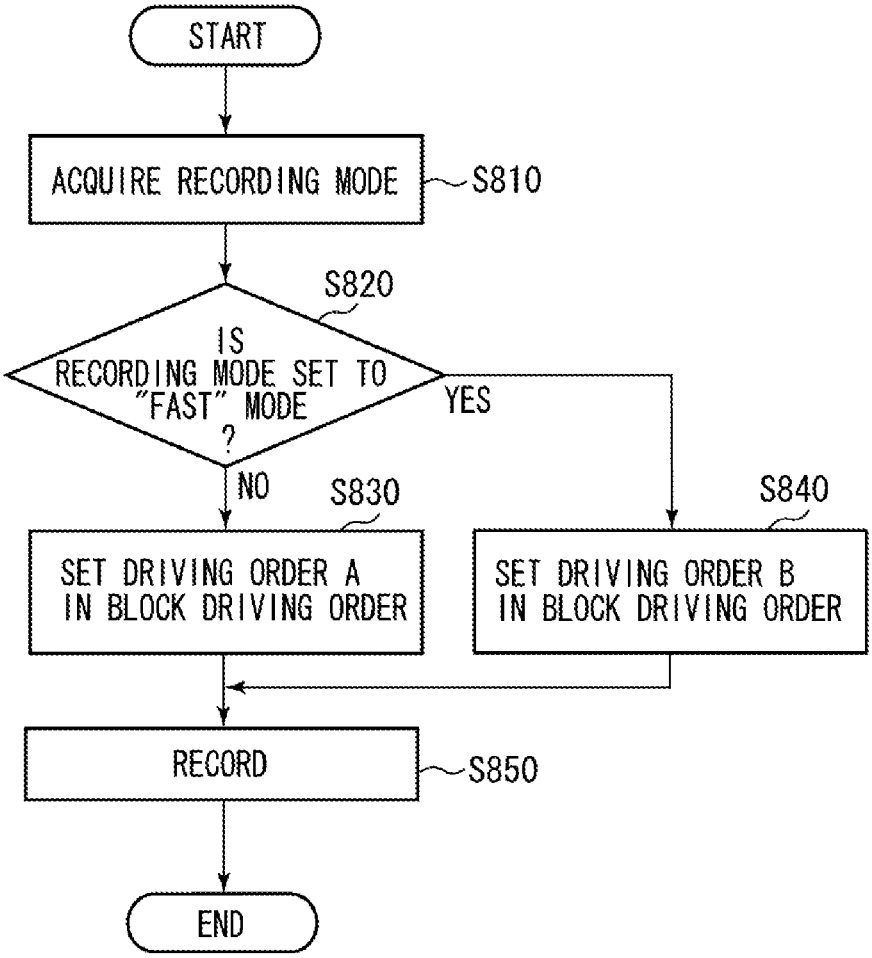
FIG. 8 illustrates control flow of a recording head.

A flow of setting a block driving order in the present exemplary embodiment will be described using FIG. 8.

Fist, when image data is received from a host computer, in step S810, the CPU 200 acquires a recording mode of the received image data. Since the received image data also contains a parameter of the recording mode, the CPU 200 acquires mode information. Acquisition of the mode information may be executed based on information input from the operation unit 206 of a recording apparatus. Next, in step S820, the CPU 200 determines whether the acquired recording mode is the "fast" mode. If the recording mode is determined not to be the "fast" mode (NO in step S820), in step S830, the CPU 200 sets a block driving order as a driving order A. In step S820, if the recording mode is determined to be the "fast" mode (YES in step S820), in step S840, the CPU 200 sets a block driving order as a driving order B. Next, in step S850, the CPU 200 executes recording of an image according to the set driving order.

As described above, if the block driving order in time-division driving is changed according to a recording mode, an undesirable influence on a recording image due to generation of a mist and a white streak is reduced, and a recording image having a high image quality is obtained. More specifically, in a speed priority recording mode which easily generates end touch, the CPU 200 records according to the distributed driving order and in an image quality priority recording mode, the CPU 200 performs recording according to the continuous driving order.

In the above-described exemplary embodiment, the block driving order of time-division driving is selected according to a recording mode. However, the block driving order can be also selected according to the amount of an air current generated during discharge of ink which highly affects generation of a mist and a white streak when image recording is executed. More specifically, the block driving order may also be selected according to a recording condition such as the number of pass, a driving speed of a carriage, a recording Duty which is a ratio of recording in one recording scan, a nozzle array formed on a recording head. Further, the driving order may also be selected according to the type of recording mediums since depending on the type of recording mediums a different ink amount is required during recording and the type of recording mediums highly affects whether degradation of a recorded image is easily recognized.

Figure 9:
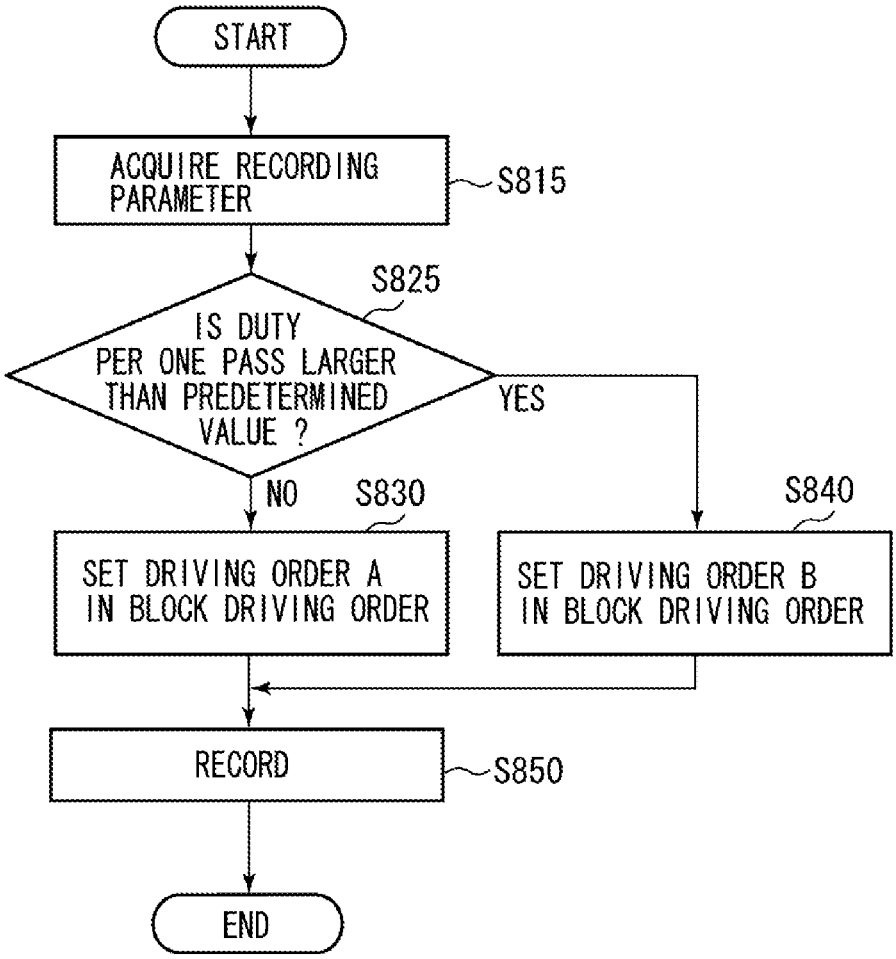
FIG. 9 illustrates another control flow of a recording head.

FIG. 9 illustrates a flowchart for selecting the block driving order in time-division driving according to a recording Duty (dot density) which is recorded in one recording scan. Only steps S815 and S825 are different from a flowchart in FIG. 8. Other steps are similar to FIG. 8, and thus, a description will be omitted.

In FIG. 9, in step S815, the CPU 200 acquires a recording Duty per one pass as a parameter during recording. At this time, with respect to a recording Duty in a plurality of recording scans to perform recording on one recording medium, its average value may be calculated and used as the recording Duty per one pass. Alternatively, the CPU 200 may acquire a recording Duty in each recording scan as a recording Duty per one pass. Either will be acceptable. Next, in step S825, the CPU 200 determines whether the recording Duty is larger than a predetermined threshold value. If the recording Duty per one pass is not more than the predetermined threshold value (NO in step S825), the processing proceeds to step S830. If it is larger than the predetermined threshold value (YES in step S825), the processing proceeds to step S840. When the recording Duty which is recorded in one recording scan is increased, since the amount of ink to be discharged per unit time is larger, an air current generated during discharge of ink is increased. Thus, when a recording Duty per one pass is increased, block driving is executed in a distributed driving order in which an air current hardly generates a white streak. In the present exemplary embodiment, a threshold value (predetermined value) for setting a block driving order in step S825 is 25% as an example.

As described above, the block driving order of time-division driving is set according to a recording condition and a recording parameter that relate to generation of an air current. Accordingly, undesirable influence on a recording image due to generation of a mist and a white streak can be reduced even when an image is recorded by using a recording head arranged at a high density. Thus, a higher-quality image can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A recording apparatus comprising:

a recording head including an element array of a plurality of recording elements for discharging a liquid from a plurality of nozzles respectively corresponding to the plurality of recording elements, the plurality of recording elements in the element array being divided into groups, wherein the recording head is configured to repeatedly move in a scanning direction intersecting a direction in which the plurality of recording elements are arranged across a recording medium and to record an image on the recording medium by ejecting ink while moving;

a selection unit configured to select a driving mode for driving the recording head from a plurality of driving modes including a continuous driving mode in which recording elements in each of the groups are driven sequentially from a recording element at a first side of a predetermined number of arranged recording elements in at least one unit in a group to a recording element at a second side of the predetermined number of arranged recording elements in the at least one unit in the group according to an arrangement order of the arranged recording elements by a predetermined interval between adjacent recording elements among the predetermined number of arranged recording elements in the at least one unit in the group, and a distributed driving mode in which recording elements in each of the groups are driven such that adjacent recording elements are not driven sequentially according to an arrangement order of the arranged recording elements and by an interval between drive timings of the adjacent recording elements among the predetermined number of arranged recording elements that is larger than the predetermined interval in the continuous driving mode; and a drive unit configured to drive the recording head in a driving mode selected by the selection unit, wherein the selection unit selects the continuous driving mode as the driving mode executed by the driving unit in a case where a duty of recording by the recording head, per one pass of the recording head across the recording medium is not larger than a predetermined value, and the selection unit selects the distributed driving mode as the driving mode executed by the driving unit in a case where the duty of recording by the recording head, per one pass of the recording head across the recording medium is larger than the predetermined value.

2. The recording apparatus according to claim 1, wherein the selection unit is configured to select the driving mode according to a recording mode selected from a plurality of recording modes including a fast mode, and wherein the selection unit selects the distributed driving mode in a case where the fast mode is selected, and selects the continuous driving mode in a case where a recording mode other than the fast mode is selected.

3. A recording method using a recording head including an element array of a plurality of recording elements for discharging a liquid from a plurality of nozzles respectively corresponding to the plurality of recording elements, wherein the plurality of recording elements in the element array is divided into groups, and wherein the recording head is configured to repeatedly move in a scanning direction intersecting a direction in which the plurality of recording elements are arranged across a recording medium and to record an image on the recording medium by ejecting ink while moving, the method comprising:

selecting a driving method for driving the recording head from a plurality of driving methods including a continuous driving method in which recording elements in each of the groups are driven sequentially from a recording element at a first side of a predetermined number of arranged recording elements in at least one unit in a group to a recording element at a second side of the predetermined number of arranged recording elements in the at least one unit in the group according to an arrangement order of the arranged recording elements by a predetermined interval between adjacent recording elements among the predetermined number of arranged recording elements in the at least one unit in the group, and a distributed driving method in which recording elements in each of the groups are driven such that adjacent recording elements are not driven sequentially according to an arrangement order of the arranged recording elements and by an interval between drive timings of the adjacent recording elements among the predetermined number of arranged recording elements that is larger than the predetermined interval in the continuous driving method; and driving the recording head based on the selected driving method, wherein in the selecting, the continuous driving method is selected as the driving method in a case where a duty of recording by the recording head, per one pass of the recording head across the recording medium is not larger than a predetermined value, and the distributed driving method is selected as the driving method in a case where the duty of recording by the recording head, per one pass of the recording head across the recording medium is larger than a predetermined value.

4. The recording apparatus according to claim 1, wherein the at least one unit in the group includes or comprises a plurality of units of the predetermined number of arranged recording elements.

5. The recording apparatus according to claim 1, wherein the selection unit selects the continuous driving mode in a case where printing of the image is completed with a first number of passes performed, on a same area of the recording medium, by the recording head, and selects the distributed driving mode in a case where printing of the image is completed with a second number of passes performed, on the same area of the recording medium, by the recording head, the second number of passes being smaller than the first number of passes.

6. The recording apparatus according to claim 2, wherein the recording modes other than the fast mode include a fine mode and a standard mode.

7. The recording apparatus according to claim 1, wherein the recording head is configured to repeatedly move forward and backward across the recording medium and record the image on the recording medium by ejecting ink while moving.

8. The recording method according to claim 3, wherein the at least one unit in the group includes or comprises a plurality of units of the predetermined number of arranged recording elements.

9. The recording method according to claim 3, wherein the recording head is configured to repeatedly move forward and backward across a recording medium and record the image on the recording medium by ejecting ink while moving.

* * * * *